US007756622B2

(12) United States Patent
Gianoglio et al.

(10) Patent No.: US 7,756,622 B2
(45) Date of Patent: Jul. 13, 2010

(54) METHOD AND DEVICE FOR DAMPING THE DISPLACEMENT OF CONSTRUCTION MACHINES

(75) Inventors: Renato Gianoglio, Turin (IT); Claudia Supparo, legal representative, Turin (IT); Frediani Salvatore, Aosta (IT); Jürgen Weber, Dresden (DE)

(73) Assignee: CNH Baumaschinen GmbH, Berlin (DE)

( * ) Notice: Subject to any disclaimer, the term of this patent is extended or adjusted under 35 U.S.C. 154(b) by 729 days.

(21) Appl. No.: 10/592,654

(22) PCT Filed: Mar. 15, 2005

(86) PCT No.: PCT/EP2005/002719

§ 371 (c)(1),
(2), (4) Date: May 14, 2007

(87) PCT Pub. No.: WO2005/090694

PCT Pub. Date: Sep. 29, 2005

(65) Prior Publication Data

US 2007/0299589 A1 Dec. 27, 2007

(30) Foreign Application Priority Data

Mar. 17, 2004 (DE) ..... 10 2004 012 945

(51) Int. Cl.

| | |
|---|---|
| ***G06F 7/70*** | (2006.01) |
| ***G06F 19/00*** | (2006.01) |
| ***G06G 7/00*** | (2006.01) |
| ***G06G 7/76*** | (2006.01) |

(52) U.S. Cl. ..... 701/50; 60/469; 37/416; 172/2; 172/35; 414/699; 188/266.2

(58) Field of Classification Search ..... 701/50; 188/266.2; 414/685, 697, 699, 719; 60/469; 91/433; 172/2, 35; 37/416
See application file for complete search history.

(56) References Cited

U.S. PATENT DOCUMENTS

| | | | | |
|---|---|---|---|---|
| 5,513,491 | A * | 5/1996 | Broenner et al. | 60/413 |
| 5,528,843 | A * | 6/1996 | Rocke | 37/348 |
| 5,535,532 | A * | 7/1996 | Fujii et al. | 37/348 |
| 5,555,942 | A * | 9/1996 | Matsushita et al. | 172/3 |

(Continued)

FOREIGN PATENT DOCUMENTS

| | | |
|---|---|---|
| DE | 42 21 943 | 3/1993 |

OTHER PUBLICATIONS

Lodige H et al: "Aktive schwingungsdampfung fur ungefederte arbeitsmaschinen" O+P Olhydraulik und Pneumatik, Vereinigte Fachverlage Krausskop, Mainz, DE.

(Continued)

*Primary Examiner*—Khoi Tran
*Assistant Examiner*—Jaime Figueroa
(74) *Attorney, Agent, or Firm*—Patrick M. Sheldrake; John William Stader; Michael G. Harms

(57) ABSTRACT

The invention relates to a method and a device for damping the displacement of construction machines, in particular wheel loaders, comprising working equipment that is driven by means of a hydraulic cylinder, a hydraulic source, a controlled valve for supplying the hydraulic cylinder with hydraulic fluid, a regulator unit comprising control software, in addition to an acceleration sensor.

14 Claims, 3 Drawing Sheets

U.S. PATENT DOCUMENTS

| | | | | |
|---|---|---|---|---|
| 5,802,847 | A * | 9/1998 | Harnischfeger | 60/413 |
| 5,832,730 | A | 11/1998 | Mizui et al. | |
| 5,884,204 | A | 3/1999 | Orbach et al. | |
| 5,890,870 | A | 4/1999 | Berger et al. | |
| 5,941,920 | A * | 8/1999 | Schubert | 701/37 |
| 6,356,829 | B1 * | 3/2002 | Fan et al. | 701/50 |
| 2001/0044685 | A1 * | 11/2001 | Schubert | 701/50 |
| 2003/0151224 | A1 * | 8/2003 | Woody et al. | 280/124.112 |
| 2005/0082127 | A1 * | 4/2005 | Barber et al. | 188/266.2 |

OTHER PUBLICATIONS

Latour C et al: "Schwingungstilgung in radladern vergleich von aktiven und passiven systemen" O+P Olhydraulik und Pneumatik, Vereinigte Fachverlage Krausskop, Mainz, DE.

* cited by examiner

METHOD AND DEVICE FOR DAMPING THE DISPLACEMENT OF CONSTRUCTION MACHINES

FIELD OF THE INVENTION

The invention concerns a method and a device for attenuating movement in self-propelled, unsprung construction machines, particularly wheeled loaders, with an implement driven by a hydraulic cylinder.

BACKGROUND OF THE INVENTION

Many generic types of self-propelled construction machines have no damping or spring system. This is firstly because springing is disadvantageous to loading procedures due to its yield under lifting and frictional forces, and secondly because provision of a spring system involves high structural outlay which entails not inconsiderable investment and maintenance costs. However, the good driving response, e.g. agility and handling, of such unsprung construction machines are accompanied by a lack of driving comfort, particularly in the working, transport and transfer cycles.

Nevertheless, the time factor is crucial to the cost-effectiveness of such construction machines. Self-propelled construction machines are frequently moved between different building sites at short notice, with the time required for transferring them—i.e. the transfer cycle—playing a decisive role.

However, in unsprung construction machines, an increase in road speed to reduce transfer times is closely linked with the requirements for driving comfort and safety and the permissible stresses for the operator from the point of view of health and safety. If a certain road speed is exceeded, high unwanted pulses and vibrations are recorded which are transmitted to the cab.

In recent years an attempt has therefore been made to find a compromise between the driving behavior and driving comfort of self-propelled, unsprung construction machines, using passive vibration attenuation systems, for example in wheeled loaders. In contrast, active vibration attenuation systems are of no practical significance to structural implementation, due to their complexity and the associated problems.

A hydraulic system in the form of a passive vibration attenuation system for mobile machines fitted with implements is known from DE 42 21 943 C2. In this case it is anticipated that a hydraulic accumulator be used as a load springing system, the hydraulic pipes responsible for raising and lowering the implement being connected between the hoist cylinder and a control valve. It is disclosed that at least one nozzle is provided in conjunction with several directional valves between the load springing system for variable adjustment of the load pressure of the hydraulic accumulator to the respective load pressure of the hoist cylinder, the valves in pilot pipes being operated by manometric switches provided between a pilot sensor and the control valve. In principle, this passive vibration attenuation system uses the yield of the hydraulic accumulator to permit an antiphase movement of the configuration, which itself attenuates the movement of a shovel in relation to the construction machine.

The disadvantage of this solution is that not only the hydraulic accumulator, but also additional directional valves, manometric switches, and nozzles must be provided in the construction machine, automatically entailing higher costs.

So-called suspension systems, which are predominantly used in agricultural tractors, are also known from the state of the art.

This involves combinations of springs and hydraulic dampers in parallel circuits. The damping characteristic is fixed in passive systems (fixed nozzles) and electronically-modifiable in active systems.

The fundamental difference between the passive vibration attenuation system described above and a suspension system lies in the mechanical structure of the moving masses, whereby the suspension system is itself a spring-damper element located between the mass of the vehicle and the individual masses of the wheels and axles, to remove unwanted vibratory movements by dissipation. An invention for the attenuation of movement in construction machines which works on the basis of an electro-hydraulic system for controlling the hoist cylinder is also known from U.S. Pat. No. 5,897,287 A. The purpose of this invention is to ensure a constant pressure in the hoist cylinders. The pressure in the hoist cylinders is permanently monitored and kept constant by means of a pressure sensor, taking the position of the shovel into account, to prevent unwanted lowering of the shovel.

The hydrodynamic valves are a particular disadvantage of this solution. They are necessary for the requisite pressure regulation, but not for attenuating movement in wheel loaders. Experience has shown that excitation/pulses or pulse oscillation generated by the pitching of the loaded shovel can be well compensated in this way, but this solution is unsuitable for cab vibrations.

In conclusion, it must be stated that the passive movement or vibration attenuation system already known from the state of the art is not optimized—or only optimized with restrictions—for changing operating conditions, and that it is only designed for quite specific problems if attenuation of cab vibration is taken into account. Transferring the suspension systems used in agricultural engineering to unsprung construction machines is not possible, for reasons of a permanent connection between the front axle and the front frame. Very high costs also arise from an unjustifiable outlay for highly-dynamic pressure control valves with the use of the active vibration attenuation system already known from U.S. Pat. No. 5,897,287 A.

A device for attenuating movement in self-propelled, unsprung construction machines (e.g. excavators) is known from U.S. Pat. No. 5,832,730. The implement is driven by means of a hydraulic cylinder. The construction machine also has a hydraulic source, a controlled valve for supplying the hydraulic cylinder with hydraulic fluid and a control unit with control software. Two pressure sensors are provided on the boom cylinder, the measurement signals from which are processed as incoming signals by the control software and converted into an acceleration signal, from which a pilot current is determined for the valve as an output variable for a compensating movement by the hydraulic cylinder. This device becomes effective when the implement is operated by the driver, i.e. the driver's control signals are overridden to attenuate movement automatically if unwanted movements occur. This specification does not disclose attenuation of movement during travel, independently of operation of the implement by the driver.

OBJECT OF THE INVENTION

The purpose of the invention is to develop a method and device for attenuating movement in construction vehicles which can be adapted to changing situations of the construction machine, e.g. cab damping or shovel damping, which is cost-effective and which can be retrofitted to hitherto unsprung construction vehicles with little outlay.

SUMMARY OF THE INVENTION

The purpose of the invention is to develop a method and device for attenuating movement in a construction machine which can be adapted to changing situations of the construction machine, e.g. cab damping or shovel damping, which is cost-effective and which can be retrofitted to hitherto unsprung construction machine with little outlay, whereby the damping is also to be optimized when the shovel is loaded. This problem is solved inventively by the characteristics of the method in accordance with patent claim 1 and by the characteristics of the device in accordance with patent claim 9. The sub-claims referring back show further advantageous embodiments of the invention.

According to the inventive concept, the method for attenuating movement in a construction machine includes the stages in the method below and relevant components of the device (a) Detection of the acceleration signal by the acceleration sensor while the construction machine is moving;

(b) Processing of the acceleration signal as an input variable by the control software of the control unit and determination of a control current for the valve as a function of the damping mode selected as an output variable for attenuating movement, and:

(c) Supplying the hydraulic cylinder with hydraulic fluid through the valve as a function of the control current.

In a preferred embodiment of the invention, the pressure signals detected by a pressure sensor in the hydraulic cylinder to determine the fill factor and/or the position of the lift frame detected by an angle sensor may also be communicated to the control unit as further input variables in addition to the input variable (A.). The pressure signals in the hydraulic cylinder indicate the fill factor or shovel load in order to determine load-dependent control parameters in an adaptive control algorithm. As the control algorithm is adaptive, i.e. self-adjusting, optimum damping in respect of the shovel load can be achieved for different operating points.

The fact that the construction machine can be operated in two different damping modes, namely cab mode and shovel mode, is particularly advantageous. Cab mode is preferably activated to obtain a higher road speed on transfer journeys. The changeover to shovel mode takes place when the shovel located on the hoist gear is damped, achieving better handling when the construction machine is working. For the sake of integrity, it should be mentioned that a combination of both damping modes is, of course, possible. The mode may be selected by the driver of the machine or, in a particularly advantageous way, automatically, by analyzing the signal from the pressure sensor in order to activate shovel mode when the shovel is full and cab mode when the shovel is empty.

Changeover between the individual damping modes by the operator is possible not only when stationary but also during movement, whereby a distinction can be made between an operating point of a pressure level and/or the road speed. Changeover between individual damping modes by the operator preferably takes place using the pressure sensor located in the hydraulic cylinder.

The principal significant characteristics and advantages of the invention over the state of the art are:

- cost-effective implementation of an active damping system by the addition of an acceleration sensor and an algorithm implemented in the control unit, using the existing electro-hydraulic system of the construction machine;
- Increasing the achievable road speeds by stabilizing the construction machine;
- Increasing productivity and driving comfort by the facility of choosing between two damping modes, e.g. cab damping and/or shovel damping;
- Implementation of speed-dependent damping by means of the adaptively-configured control unit and
- determination of the fill factor of the shovel by means of an optional pressure sensor.

It is anticipated that the device for attenuating movement in self-propelled, unsprung construction machines, particularly wheeled loaders, will have a hydraulic source in the form of an implement driven by a hydraulic cylinder, a controlled valve for supplying hydraulic fluid to the hydraulic cylinder, at least one sensor for detecting a physical measured variable and a control unit with control software, an acceleration sensor being provided as a sensor and the control unit being configured to process the signals from the acceleration sensor as input signals by means of the control software and to determine a pilot current for the valve as an output variable for a compensatory movement of the hydraulic cylinder.

The inventive device differs from the state of the art in that speed control of the hydraulic cylinder on the basis of acceleration feedback is exercised instead of pressure regulation. No highly-dynamic valves are necessary, so the valve can be used in an advantageous way for the working circuit of the control block.

If the construction machine is fitted with an electro-hydraulic system, i.e. if the main control block for controlling the working functions is actuated by a controller using electrical signals, no further additional hydraulic components or special electronic components will be required to complete the task.

The acceleration forces acting directly upon the shovel and/or cab of the construction machine can be detected by the acceleration sensor, to initiate an antiphase movement of the hydraulic cylinder. The signal detected by the acceleration sensor is communicated to the control unit, where it may be weighted with a pressure signal and a distance-compensating signal and converted into a corresponding signal which determines the current destined for the valve controlling the hydraulic cylinder. A cross-section of the actuated valve is then opened, permitting a corresponding volumetric flow to the hydraulic cylinder.

The acceleration sensor may be located at any point on the construction machine, but preferably in the vicinity of the function or the sub-assembly of the machine to be damped, i.e. the shovel or driver's cab of the construction machine.

All external excitation of the construction machine entails the effect of unwanted force and thus movement on the structure of the machine. The inventive movement attenuation system generates a counterforce in the hydraulic cylinders of the working configuration, particularly advantageously in the hoist cylinders, by means of the hydraulic fluid, to compensate for the effect of force or movement. In a particularly advantageous embodiment of the invention, the pressure signal is detected by a pressure sensor, which is preferably located in the vicinity of the rear flange of the hydraulic hoist cylinder. This pressure signal represents the fill factor of the shovel of the configuration. As the fill factor may fluctuate constantly, provision is made for the control unit to be configured adaptively. In this way, optimum compensation for vibration adapted to the load may be achieved. The pressure sensor is consequently in a position to distinguish an empty shovel from a full one and to communicate the corresponding signal to the control unit.

The pressure sensor can be complemented by an angle sensor or by another position sensor (e.g. a hoist sensor for a hoist cylinder). The angle sensor detects the position of the lift frame and compares it with the reference value previously saved. A controller processes the deviation of the angle position from the reference position. An admissible range for the position of the lift frame can be specified in an advantageous way in the control unit, the content of which during the attenuation movement is one of the control or regulatory tasks of the control facility. The current position can be measured by an angle sensor located on the lift frame.

The control unit provided on the construction machine for controlling the working function is inventively complemented by control software, the algorithm of which can contain multiple damping functions. Whilst only the unwanted acceleration of the shovel could hitherto be compensated by state of the art movement attenuation systems, the appropriate damping functions can now be activated by selecting a desired damping mode. Typical damping functions for the shovel mode, cabin mode but also for the combined mode are provided in the software. An appropriate pilot current for the valve is released as a function of the damping mode selected, according to the relevant damping function.

BRIEF DESCRIPTION OF THE DRAWINGS

Further details, features and advantages of the invention emerge from the following description of a specimen embodiment, referring to the relevant drawings.

DETAILED DESCRIPTION OF THE PREFERRED EMBODIMENT

Figure 1:
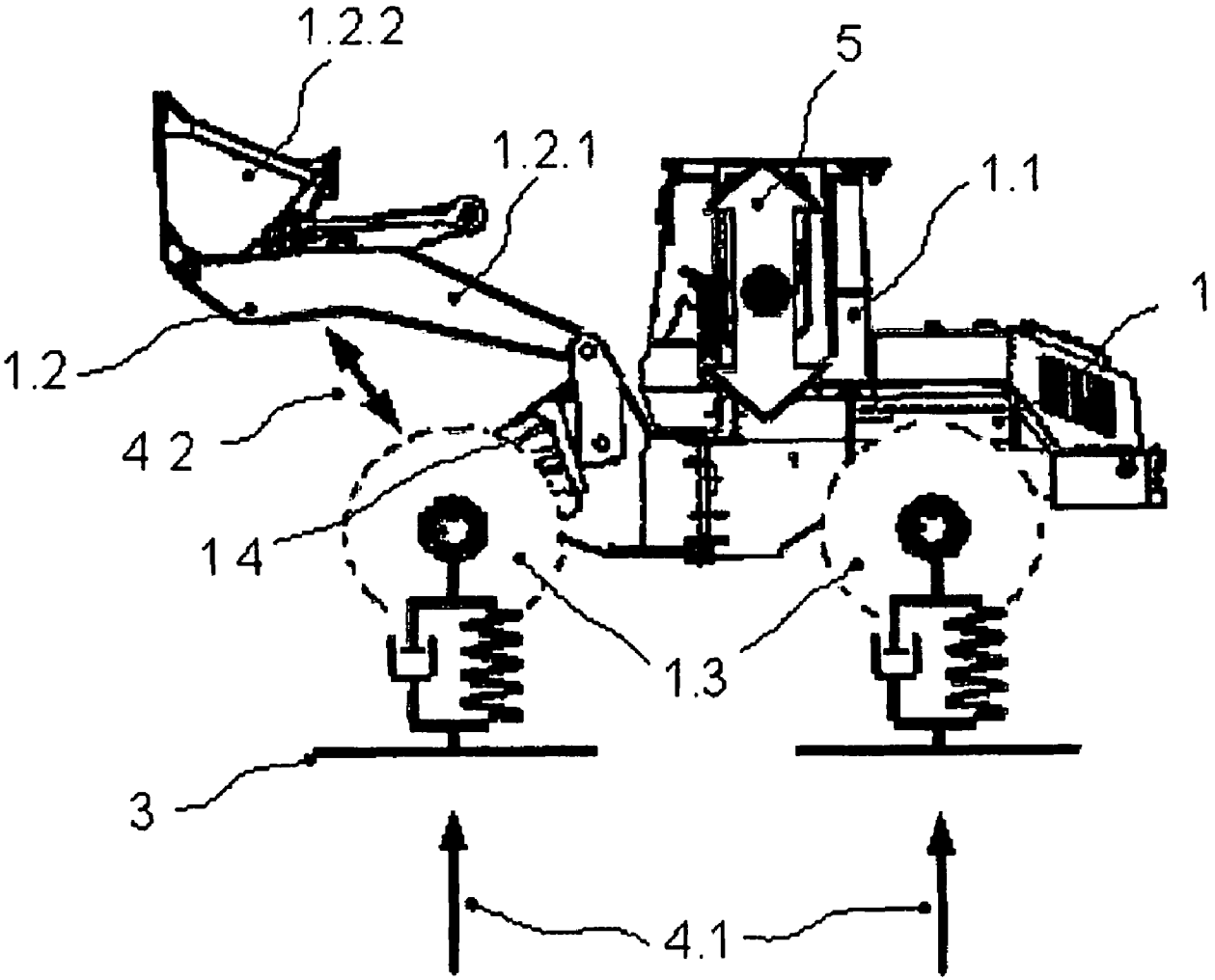
FIG. 1 is a diagrammatic representation of the external excitation/pulses affecting a construction machine.

FIG. 1 is a diagrammatic illustration of the external excitation/pulses 4 which typically affect a piece of construction machinery 1. The cab 1.1 of the wheeled loader shown here undergoes vertical acceleration by carriageway excitation 4.1 and excitation 4.2 by movement of the configuration. On one hand, the excitation/pulses 4 or bounce generated by unevenness of the carriageway 3 during travel is transmitted to the cab 1.1 by the tires 1.3 and on the other hand the excitation/pulses 4.2 generated by pitching of the shovel 1.2.2 or pulse oscillations from the hydraulic cylinder 1.4 not shown are transmitted to the cab 1.1. In the absence of a damping system, vehicle or cab damping is solely by the tires 1.3 of the construction machine 1. Excitation/pulses from the carriageway 4.1 or configuration 4.2 may be superimposed on each other during the working or transfer cycle of the construction machine 1, entailing increased and thus unwanted cab acceleration.

Figure 2:
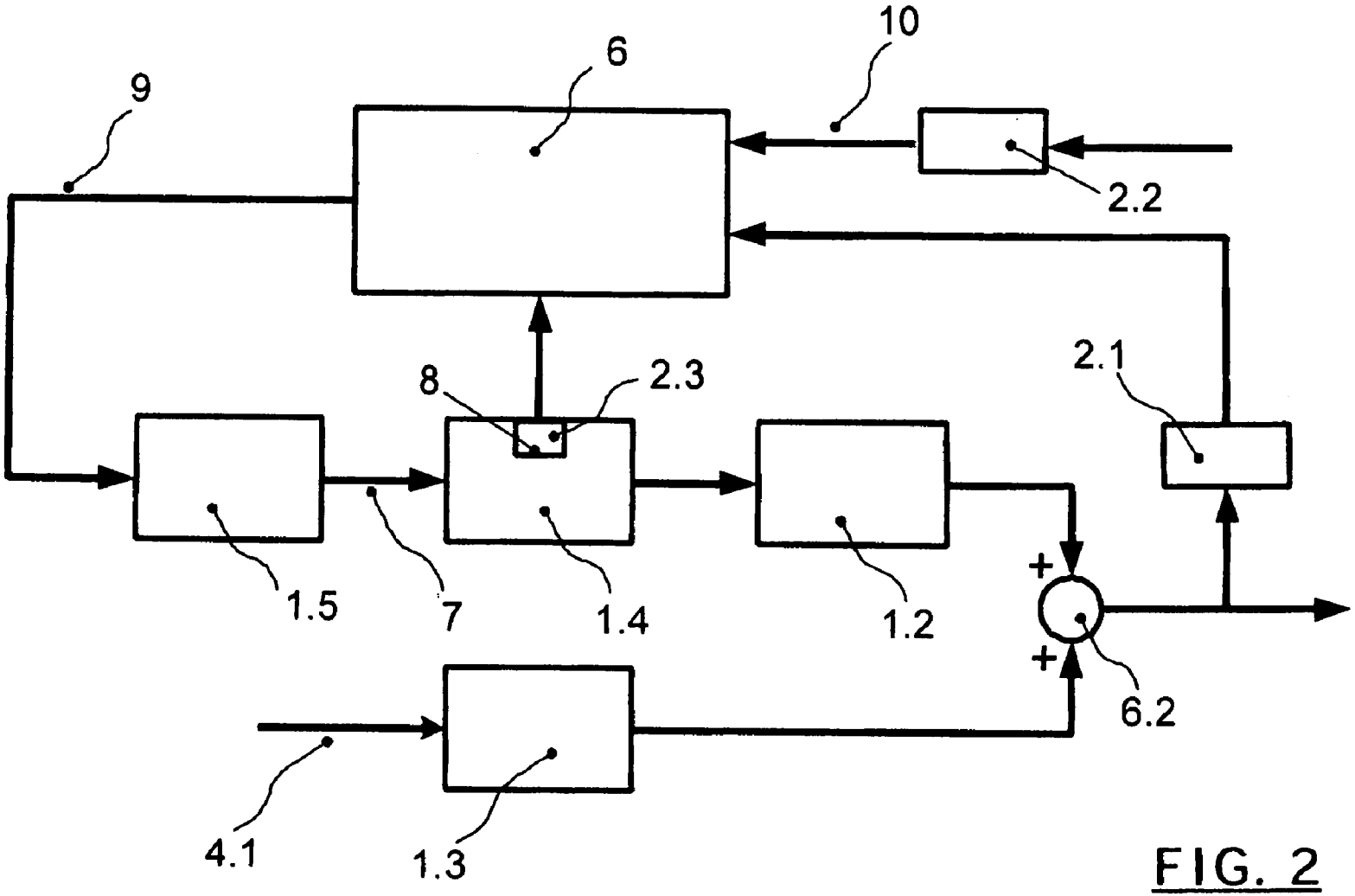
FIG. 2 shows control system architecture of the device for attenuating movement.

FIG. 2 shows the control system architecture of the device for attenuating movement in a construction machine 1 in a closed control circuit. This specimen embodiment illustrates activation of the hydraulic cylinder 1.4 when excited by the configuration 1.2 shown in FIG. 1 and by the carriageway 3, using the inventive acceleration sensor 2.1, the angle sensor 2.2 and the pressure sensor 2.3.

The construction machine 1 shown in FIG. 1 has an ex works valve 1.5 of the control block not shown, a control unit 6, the angle sensors 2.2, the optional pressure sensor 2.3 and an acceleration sensor 2.1.

Excitation 4.1 of the construction machine 1 by the carriageway 3 is transmitted through the wheels/tires 1.3 of the construction machine 1 just as the excitation 4.2 by the configuration 1.2 is transmitted to the cab 1.1 of the construction machine 1. This mutually superimposed excitation 4 is detected by an acceleration sensor 2.1 and communicated to the control unit 6 as an electrical signal. This electrical signal forms the first input variable for the control unit 6. The position 10 of the lift frame 1.2.1 is communicated to the control unit 6 as a further input variable. The position 10 of the lift frame 1.2.1 is monitored by the ex works angle sensors 2.2 on the construction machine 1 to avoid over-long hydraulic cylinder strokes and configuration position drift. In addition, the pressure 8 in the hydraulic cylinder 1.4 is also measured by a pressure sensor 2.3 in the specimen shown here. The fill factor of the shovel 1.2.2. can be determined by this optionally-useable pressure sensor 2.3. The goods with mass located in the shovel 1.2.2 exercises a compressive force on the hydraulic cylinder 1.4, which is detected by the pressure sensor 2.3. The input signals of the sensors 2 or measurement converter are processed to generate an output signal according to an algorithm shown in FIG. 3. The output signal is an electrical signal and provides the current for a valve 1.5 of a control block not shown. A cross-section of the valve 1.5 is opened, whereby the current is proportional to the volumetric flow 7 released. The hydraulic cylinder 1.4 is moved by the admission and discharge of hydraulic fluid, the stroke speed then being proportional to the released volumetric flow 7 and the reciprocating movement of the hydraulic cylinder 1.4 corresponding to a movement compensating for carriageway excitation 4.1 and configuration excitation 4.2. The pressure S then arising in the hydraulic cylinder 1.4 is again detected by the pressure sensor 2.3 and communicated to the control unit 6. The external excitations 4 not attenuated by the control unit 6 of the construction machine 1 are detected as acceleration 5 by the acceleration sensor 2.1 and communicated to the control unit again. This closes the control circuit.

An antiphase movement of the hydraulic cylinder 1.4 can be generated by means of this control strategy using the components described above, in order to compensate for the external excitation 4, e.g. the cab excitation 4.1 or configuration excitation 4.2.

Figure 3:
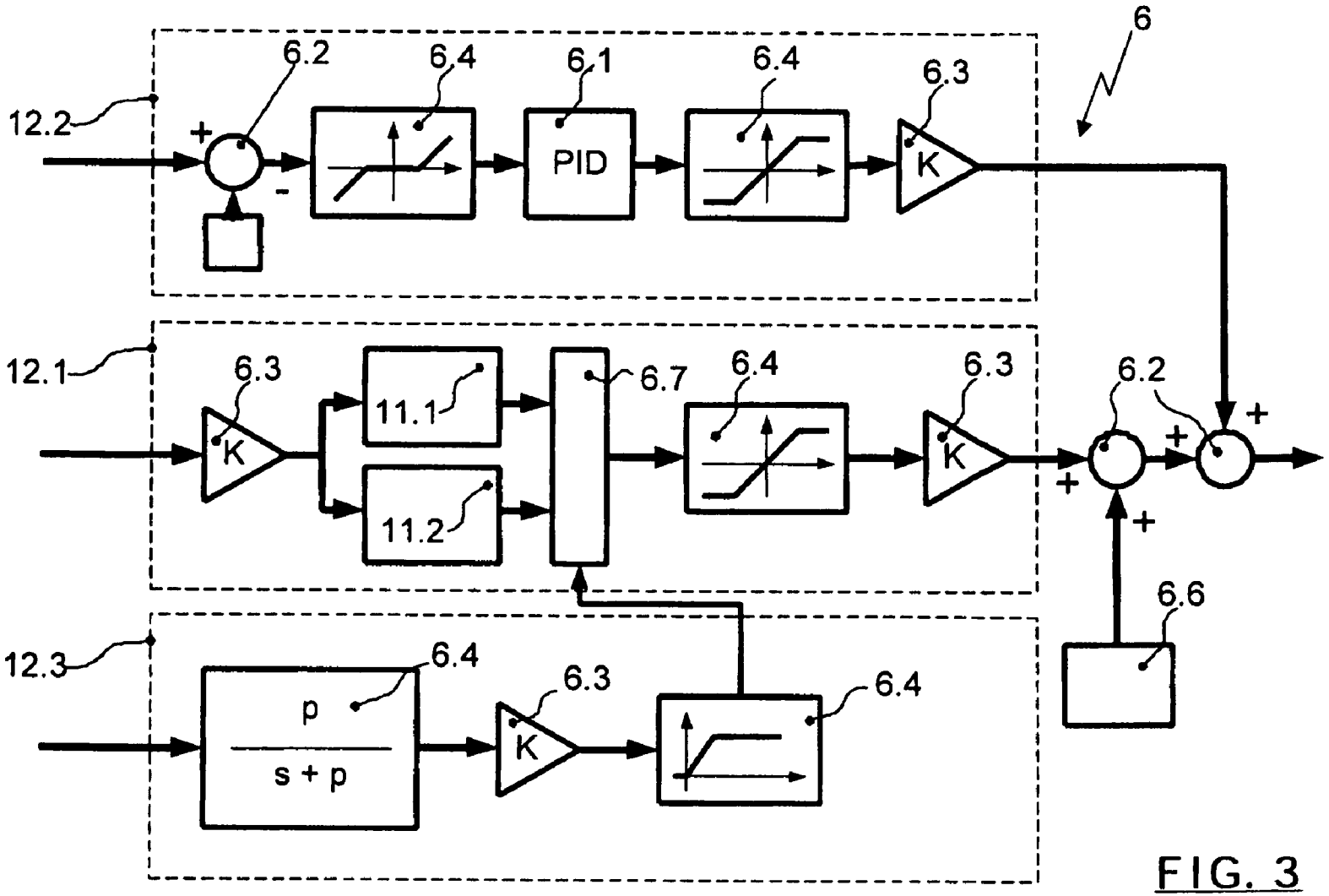
FIG. 3 shows the signal structure of the device for attenuating movement.

FIG. 3 shows the signal structure of the device for attenuating movement. The control unit 6 implements an algorithm for processing the input signals. The control unit 6 has three modules 12, namely the active ride compensator 12.1, the boom position compensator 12.2 and the load compensator 12.3, each module 12.1-12.3 processing at least one input signal and generating a corresponding output signal.

The active ride compensator 12.1 processes the signal from the acceleration sensor 2.1 and determines the pilot current 9 for the valve 1.5, to initiate a compensating reciprocating cylinder movement. The acceleration detected is amplified by an amplifying element and converted into a signal as a function of a selected damping mode 11 by means of an interpolation function. However, the interpolation function is only activated by a generated signal from the load compensator 12.3 described below.

Damping modes 11, cab damping 11.1 and shovel damping 11.2 include different mathematical transfer functions, which can be initiated individually or with a combined effect. The signal generated for the pilot current 9 is amplified immediately before it leaves module 12.1. The excess present in valve 1.5 is also compensated by an additional proportion 6.6 of the pilot current 9.

The signal is communicated to the boom position coordinator 12.2, which represents the position 10 of the lift frame 1.2.1. This signal is detected by angle sensors 2.2 located on the lift frame 1.2.1. When the damping function is initiated, the system saves the current position 10 of the lift frame 1.2.1 as a reference position. If the load introduced into the shovel 12.2 of the implement 1.2 changes, the pitch angle will change, whereby the position 10 of the lift frame 1.2.1 will change.

This angle position is detected by the angle sensor 2.2 and compared with the reference position in the boom position compensator 12.2. The deviation of the angle position from the reference position is processed by a PID controller 6.1 and subsequently further processed by a transfer element 6.4 in the form of a limiter. The position controller is not activated until the position of the lift frame departs from an admissible range. The signal generated by the PID controller and restricted by the limiter is now added to the signal generated by the active ride compensator.

The load compensator processes the signal from the pressure sensor 2.3, which is located in hydraulic cylinder 1.4. The pressure in the hydraulic cylinder 1.4 indicates the fill factor of the shovel 1.2.2 or the compressive force applied to the hydraulic cylinder 1.4 by the goods with mass located in the shovel 1.2.2. The signals from the pressure sensor 2.3 are covered by means of a transmission element, subsequently amplified by an amplifying element and then processed by a low-pass filter. The low-pass filter only filters out the steady-state proportion of the signal, which is in proportion to the shovel load or shovel filling. The signal generated is now communicated to the active ride compensator and initiates the aforementioned interpolation function, as a function of the intensity of the signal. The interpolation function includes determination of the controller parameters of the active ride compensator as a function of the shovel load.

It was possible to prove that cab acceleration 5 of construction machine 1 excited by carriageway and configuration 4.1, 4.2 was considerably reduced in a specific frequency band by the device and method for attenuating movement compared to passive movement attenuation systems. Measurements demonstrated that the relative attenuation of movement still increased as the shovel load increased. In conclusion, it may be stated that the inventive movement attenuation system produces a sustained improvement in machine stability and ensures better tractability of construction machine 1, particularly at high road speeds.

The invention claimed is:

1. A method of attenuating movement in a self-propelled, unsprung construction machine, particularly a wheeled loader, with a cab, a shovel driven by a hydraulic cylinder, a hydraulic source, a controlled valve for supplying the hydraulic cylinder with hydraulic fluid, a control unit with control software and at least one sensor in the form of an acceleration sensor configured to detect oscillations of the construction machine imposed by both a carriage way and the shovel, whereby the method includes the following stages:

a) detection of the acceleration signal by the acceleration sensor while the construction machine is moving;

b) selection of a damping mode from several adaptable damping functions stored in the control unit to minimize cab acceleration and/or minimize acceleration of the shovel;

c) processing of the acceleration signal as an input variable by the control software of the control unit and determination of a control current for the valve as an output variable for attenuating movement as a function of the damping mode selected and a shovel load signal detected from a second sensor; and d) supplying the hydraulic cylinder with hydraulic fluid through the valve as a function of the control current.

2. The method of attenuating movement according to claim 1, wherein the determination of a pilot current by the control unit for the valve takes place in a first damping mode for maximum damping of the cab or in a second damping mode for maximum damping of the shovel.

3. The method of attenuating movement according to claim 1, wherein the damping mode is selected by the operator of the construction machine.

4. The method of attenuating movement according to claim 1, wherein the selection of the damping mode takes place automatically as a function of the fill factor of the shovel.

5. The method of attenuating movement according to claim 4, wherein the second sensor is a pressure sensor located in the hydraulic cylinder is used to determine the fill factor of the shovel, the pressure signals from which are communicated to the control unit, wherein the pressure signal are communicated to a active ride compensator of the control unit which calculates the control current as a function of the intensity of the pressure signal representing the shovel load.

6. The method of attenuating movement according to claim 5, wherein the position of the shovel detected by an angle sensor is also communicated to a boom position compensator of the control unit as a further input variable, to counteract inadmissible reciprocal hydraulic cylinder movements; the position of the shovel upon initiating of damping cycle is as a reference position through the boom position compensator and as the angle of the shovel deviates outside of a predetermined range the boom position compensator generates a signal that is added to the signal generated by the active ride compensator.

7. The method of attenuating movement according to claim 1, wherein the road speed of the construction machine detected by a speed sensor is also communicated to the control unit as a further input variable, to select an optimum damping mode adapted to the speed.

8. A device for attenuating movement in a self-propelled, unsprung construction machine, particularly a wheeled loader, with a cab, a shovel driven by a hydraulic cylinder, a hydraulic source, a controlled valve for supplying the hydraulic cylinder with hydraulic fluid, comprising at least one sensor in the form of an acceleration sensor configured to detect oscillations of the construction machine imposed both a carriage way and the shovel; and a control unit configured for active ride control, with control software, the control unit having several adaptable damping functions for minimizing acceleration of the cab minimizing acceleration of the shovel and is configured to process the signals from the acceleration sensor as an input signal by the control software and to determine a pilot current for the valve as an output variable for a compensating movement of the hydraulic cylinder as a function of the damping mode stored in the damping function in the control unit and a shovel load signal detected from a second sensor.

9. The device according to claim 8, wherein the control unit has at least one first damping mode for maximum damping of the cab and a second damping mode for maximum damping of the shovel.

10. The device according to claim 8, wherein the second sensor is a pressure sensor is provided for detecting the pressure in the hydraulic cylinder to determine the fill factor of the shovel as a further input variable for the control unit, the control unit configured to calculate the output variable as a function of the input signal from the acceleration signal as a function of the intensity of the signal from the pressure sensor to facilitate optimum compensation of vibration adapted to the load.

11. The device according to claim 10, wherein an angle sensor is provided for detecting the position of the lift frame as a further input variable for the control unit, to counteract inadmissible reciprocating movements by the hydraulic cylinder; the control unit configured to record the position of the lift frame upon initiating a damping cycle as a reference position and wherein the controller is configured to calculate the output signal also as a function of the position of the lift frame, when the lift frame is outside a predetermined range.

12. The device according to claim 8, wherein a speed sensor is provided to detect the road speed of the construction machine as a further input variable for the control unit, to facilitate optimum compensation of vibration relative to speed.

13. The device according to claim 8, wherein the acceleration sensor is located on the cab of the construction machine.

14. The device according to claim 8, wherein the acceleration sensor is located in the vicinity of the shovel of the construction machine.

* * * * *